United States Patent [19]

Mathews

[11] 4,217,701

[45] Aug. 19, 1980

[54] BIN GRAIN DRYER

[76] Inventor: Bernard C. Mathews, 8606 Rte. 176, Crystal Lake, Ill. 60014

[21] Appl. No.: 32,714

[22] Filed: Apr. 23, 1979

[51] Int. Cl.[2] ..... F26B 25/06

[52] U.S. Cl. ..... 34/211; 34/66; 34/67; 34/174; 414/310

[58] Field of Search ..... 34/65, 64, 62, 66, 67, 34/211, 215, 216, 174; 414/310, 311, 312

[56] References Cited

U.S. PATENT DOCUMENTS

| | | | |
|---|---|---|---|
| 2,914,198 | 11/1959 | Hein | 414/310 |
| 3,282,446 | 11/1966 | Laidig | 414/312 X |
| 3,416,239 | 12/1968 | Louks | 34/211 |
| 3,479,748 | 11/1969 | Sietmann | 34/174 |
| 3,487,961 | 1/1970 | Nevenschwander | 414/310 X |
| 3,501,845 | 3/1970 | Sietmann | 34/174 X |
| 3,624,921 | 12/1971 | Easton | 34/211 |
| 3,849,901 | 11/1974 | Sietmann et al. | 34/167 X |
| 4,142,302 | 3/1979 | Primus | 34/66 X |

*Primary Examiner*—Henry C. Yuen
*Assistant Examiner*—Harold Joyce
*Attorney, Agent, or Firm*—Kenneth T. Snow

[57] ABSTRACT

A generally vertically disposed bin arranged to receive grain to be dried. Moist grain enters the bin through the top at which point it is distributed relatively uniformly over the full planar area thereof. The bin is equipped with a first floor having air passage perforations therein. The first perforated floor is adapted to carry a substantial column of the moist grain thereon which is subjected to the passage of hot air moving upwardly therethrough. An auger sweep is arranged and constructed to regularly remove portions of the grain lying closest to the surface of the perforated first floor and discharge that grain downwardly through a passageway in the first floor where it is distributed relatively uniformly over a substantial column of grain carried on a second floor spaced beneath the first floor in the bin. The second floor also has air passage perforations therein to permit passage upwardly therethrough of cool air. An auger sweep is arranged and constructed to regularly remove portions of the grain lying closest to the surface of the perforated second floor and discharge that grain downwardly through a passageway in the second floor where it is deposited on a radially disposed conveyor in the bin below the second perforated floor to deliver the grain out of the bin.

4 Claims, 5 Drawing Figures

BIN GRAIN DRYER

BACKGROUND OF THE INVENTION

1. Field of the Invention

The present invention is concerned with the drying of grain in the usual bins used just for storage of grain. Grain when it is initially harvested usually is too moist to safely store in confined bins without a preliminary drying of the grain. It is a principal feature of this invention to provide grain drying mechanisms in the storage bins so that storage can commence immediately after harvesting or at any time even if the grain is too moist for the usual storage practices. Applicant has a conversion device to cause a storage chamber to become in fact a dual purpose chamber of storing and drying. Others previously have utilized storage bins to accept moist grain but they were primarily concerned with uneven drying and employed methods for recirculating, agitating or stirring the grain in the bin. Some earlier bin drying devices provided for the circulation of the grain within the bin by removing a portion of the grain from the bottom of a column of grain within the bin and reapplying it to the top of that same column. At certain times hot air would be delivered upwardly through the column of moving grain and at other times atmospheric air would be sent upwardly through the column of grain. These hot and atmospheric air currents did not as a rule act in unison nor could most of them be used together because of the physical structure of the devices. In still other prior devices perforated floors have been utilized to permit the passage of air currents. Some of these floors were conical in shape to hopefully cause the grain to spread over the full area of the bin by gravity. Many of the prior devices utilized auger sweeps for both distribution of grain and removal of grain. Applicant utilizes columns of grain within the bin to effect drying of grain. In applicants device moist grain is delivered into the top of a bin and in a first or upper chamber a column of grain is subjected to hot air and in a second or lower chamber located directly beneath the first chamber a second column of grain is simultaneously subjected to cool air. Thereafter grain is removed from a sub-chamber within the bin when the grain has been completely dried. Thus the grain, entering moist at the top makes one pass through the entire bin from top to bottom and is then delivered out of the bin in a dry cool condition. Both the hot air and cool air simultaneously pass upwardly through the columns of grain where the used air is exhausted out an opening in the top spaced apart from the moist grain inlet. Because of the two vertically spaced apart perforated floors, the cool air passing up through the column of grain in the lower chamber is permitted to mix with the incoming hot air for upward movement through the column of grain in the upper chamber. The grain moving down from the upper column is quite warm so that it acts to heat up the initially cool air which was delivered to the bottom of the lower column but which is now moving upwardly into the bottom of the uppermost column of grain. It is this entire system of operation accompanied by special auger sweep drive means that applicant has developed.

2. Description of the Prior Art

Extensive searches of the prior art have produced a variety of patents showing grain storage bins and grain drying bins with various means for circulating or agitating the grain within the bin at a time when the grain therein was subjected to drying processes.

The very old U.S. Pat. No. 765,795 to Smith shows the admission of heat into a column of grain at a position approximately midway of the height of the column.

The U.S. Pat. No. 3,156,541 to Kalke shows a grain storage bin with means for effecting stirring of the grain by a vertical auger depending into a column of grain in the bin.

The Sukup U.S. Pat. Nos. 3,198,493 and 3,272,480 disclose an auger means disposed generally vertically but swingable throughout an arcuate range for stirring or agitating the grain in the bin to more readily permit the passage therethrough of hot air or the like. This appears to be an improvement over the Kalke patent already discussed. Sukup also discloses a radially disposed auger for effecting a spreading or a distribution of the grain within a bin.

The Batterton et al U.S. Pat. No. 3,440,734 is similar to Smith U.S. Pat. No. 765,795 in that it discloses the delivery of heat into a column of grain being dried at a position intermediate the top and bottom of the column.

The Francis U.S. Pat. No. 3,449,840 shows a grain drying apparatus in which incoming grain is delivered to a trough member having radially disposed conveyor means therein. The stream of grain entering this trough member is distributed radially on the trailing side of the trough sweep while another conveyor on the trough is removing grain from the lead side of the sweeping trough. Thus the Francis principle is to maintain a very shallow layer of grain which is subjected to heat during one revolution of the trough at which time the dried grain is removed.

The U.S. Patents to Sietmann No. 3,479,748; Sietmann No. 3,501,845; and Sietmann et al No. 3,849,901 all show grain bins in which drying of the grain is the goal to be attained. All of these devices employ conically shaped perforated floors disposed just beneath a conical top to temporarily hold the incoming grain while it is subjected to hot air moving upwardly therethrough. The conical floors are ostensibly used to cause grain distribution but this then necessitates the use of complicated dams to obtain even a short column of grain and they are not commensurate to applicant's flat floors with substantial full cylindrical columns of grain.

The Shivvers U.S. Pat. Nos. 3,563,399; 3,765,547; and 3,765,548 all show a bin with a central auger disposed vertically therein for recirculating the bin's grain. When the grain moving gradually downwardly reaches the bottom it is then taken upwardly by the central auger and deposited onto the top of the column. During this recirculation process the grain is subjected first to hot air and then at a different time this same column of grain is subjected to atmospheric air. At no time are the hot air and atmospheric air currents moving together as in applicant's device.

The Lambert, Jr. U.S. Pat. No. 3,755,917 is similar in construction to the Francis patent previously described. Here the incoming grain is delivered to a very narrow but elongated box-like member called a duct and it is within this narrow duct that the grain is preliminarily dried.

The Patterson U.S. Pat. No. 3,800,964 shows and describes an auger sweep in a grain drying bin which is equipped with spaced apart cogs on the helical edge of the auger so that the cogs define a segmented spiroid rim. This construction is supposed to enhance rotation of the sweep about its center.

The Rutten et al U.S. Pat. No. 4,029,219 shows a grain storage bin but is concerned only with a clutch means disposed at a location outside the bin through which the drive to sweep auger is delivered.

From the numerous patents discussed and described very briefly above it is obvious that this is indeed a crowded art. In no instance did we find an entire drying system of superposed full cylindrical columns of grain for effecting the drying of moist grain. In applicant's device grain is delivered to and into the top of a bin where it is subjected to a controlled descent through a first upper column and thence through a second lower column to a sub-chamber where it is discharged. Applicant's grain is dried without going through a recirculating cycle or without auxiliary agitation. In applicant's device the moist grain is first subjected to hot air in an upper column and then subjected to cold air in a second lower column. The incoming hot air and the exhausting air from the coolant chamber is admixed for passing through the first or upper column of grain. After the grain moves downwardly through these superposed separate columns of grain it is discharged from a sub-chamber beneath the second lower column of grain.

Further, although there are many that have used radially disposed auger sweep members we have not been able to find that anyone has utilized an auger at the outer end of the radial auger and disposed at right angles thereto for effecting drive of that sweep auger in a circular direction through a massive column of grain during drying. Thus applicant has developed an entire system for the drying of grain within an ordinary grain storage chamber. Applicant's drying system includes sweep augers which are positively driven through the bottoms of columns of grain despite the depths of the columns.

SUMMARY OF THE INVENTION

A principal object of the present invention is to provide a novel combination bin for the storing and drying of grain.

An important object of this invention is to provide an entire novel system for drying grain by delivering moist grain into the top of a storage bin, controlling delivery of the grain downwardly through the bin comprising two vertically spaced apart columns of grain and the positive removal of grain from the bottoms of both columns, subjecting the grain in the bin simultaneously to hot air and cool air, and removing fully dried grain from the bottom of the bin.

Another important object of this invention is to provide a novel system for converting a usual storage bin to a combination storage and drying bin.

Still another important object of this invention is to provide a novel cylindrically shaped grain drying bin having two vertically spaced apart perforated flat floors therein, each of which is adapted to carry a substantial column of grain to be dried.

Another and still further important object of this invention is to provide radially disposed auger sweeps with auxiliary auger means at the outer ends thereof for the positive driving of the auger sweep in a revolving manner over the flat perforated floors to accurately control the movement of the grain in its downward travel through the cylindrical bin.

Other and further important objects and advantages of this invention will become apparent from the disclosures in the following specification and accompanying drawings.

IN THE DRAWINGS

Figure 1A:
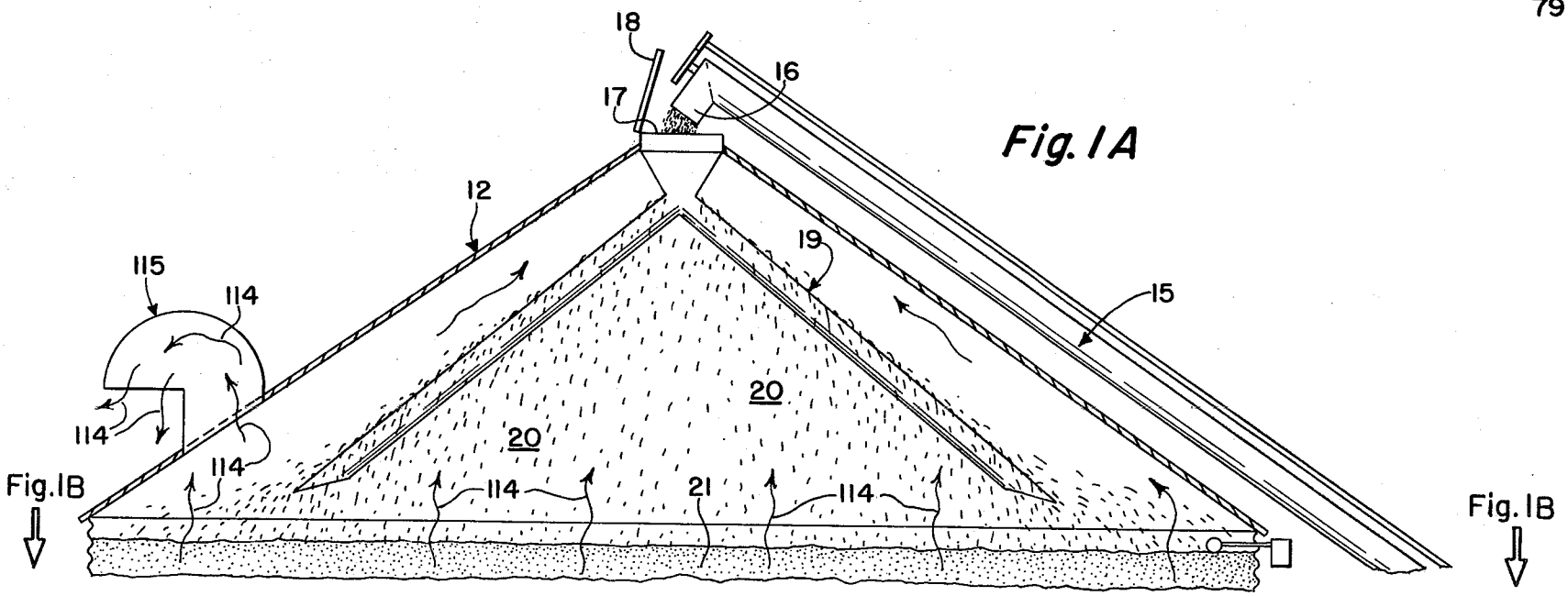
FIG. 1A is the upper portion of a vertical sectional view of a grain storage and drying bin.
Figure 1B:
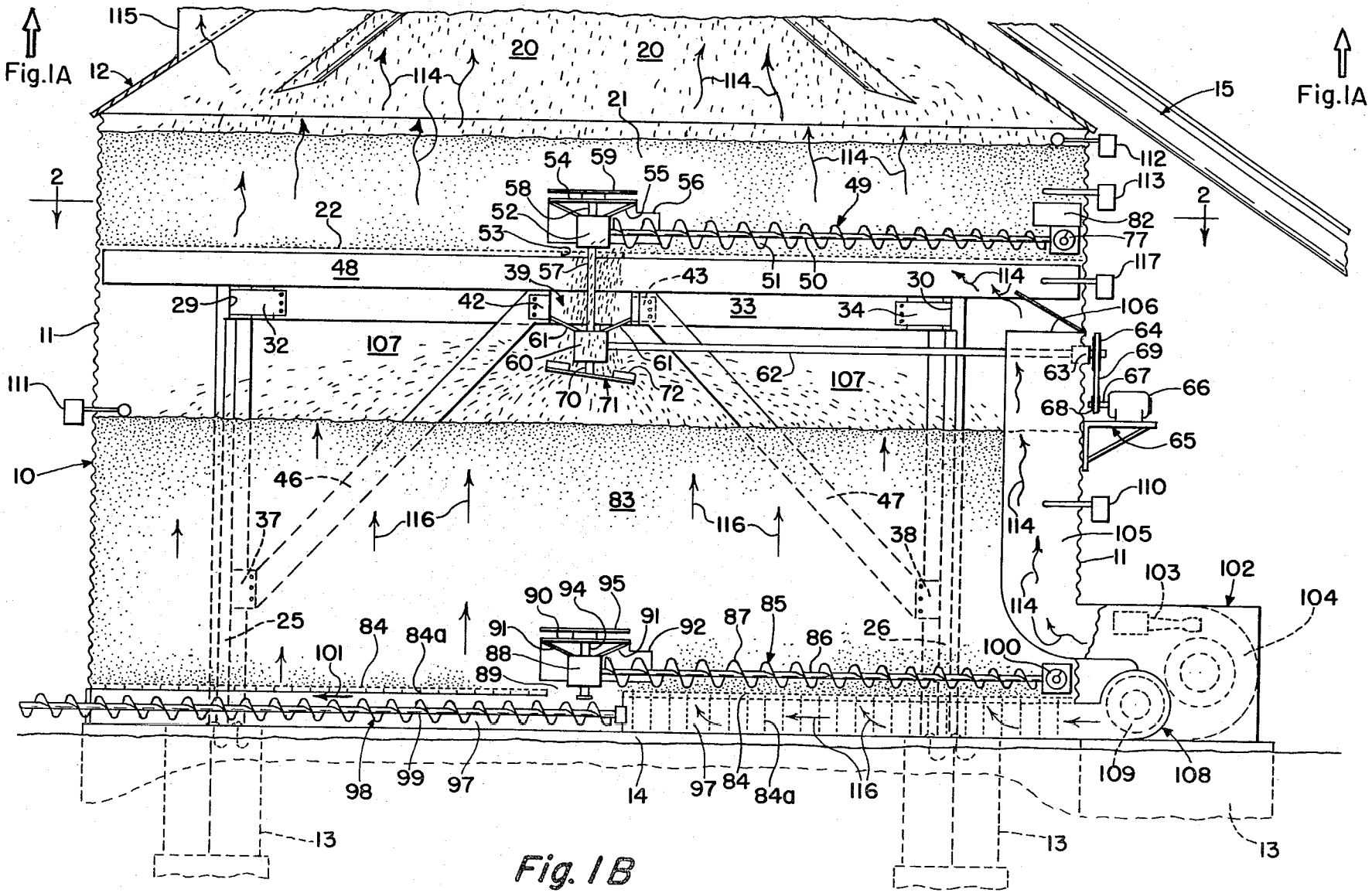
FIG. 1B is the lower portion of the vertical sectional view of FIG. 1A showing the remainder of the grain storage and drying bin.

NOTE: FIG. 1 has been divided into the two parts in order to keep the scale of this view as large as possible. FIG. 1A has been shown on Sheet 1 of the drawings and FIG. 1B, the lower continuation thereof, has been shown on Sheet 2 of the drawings.

Figure 2:
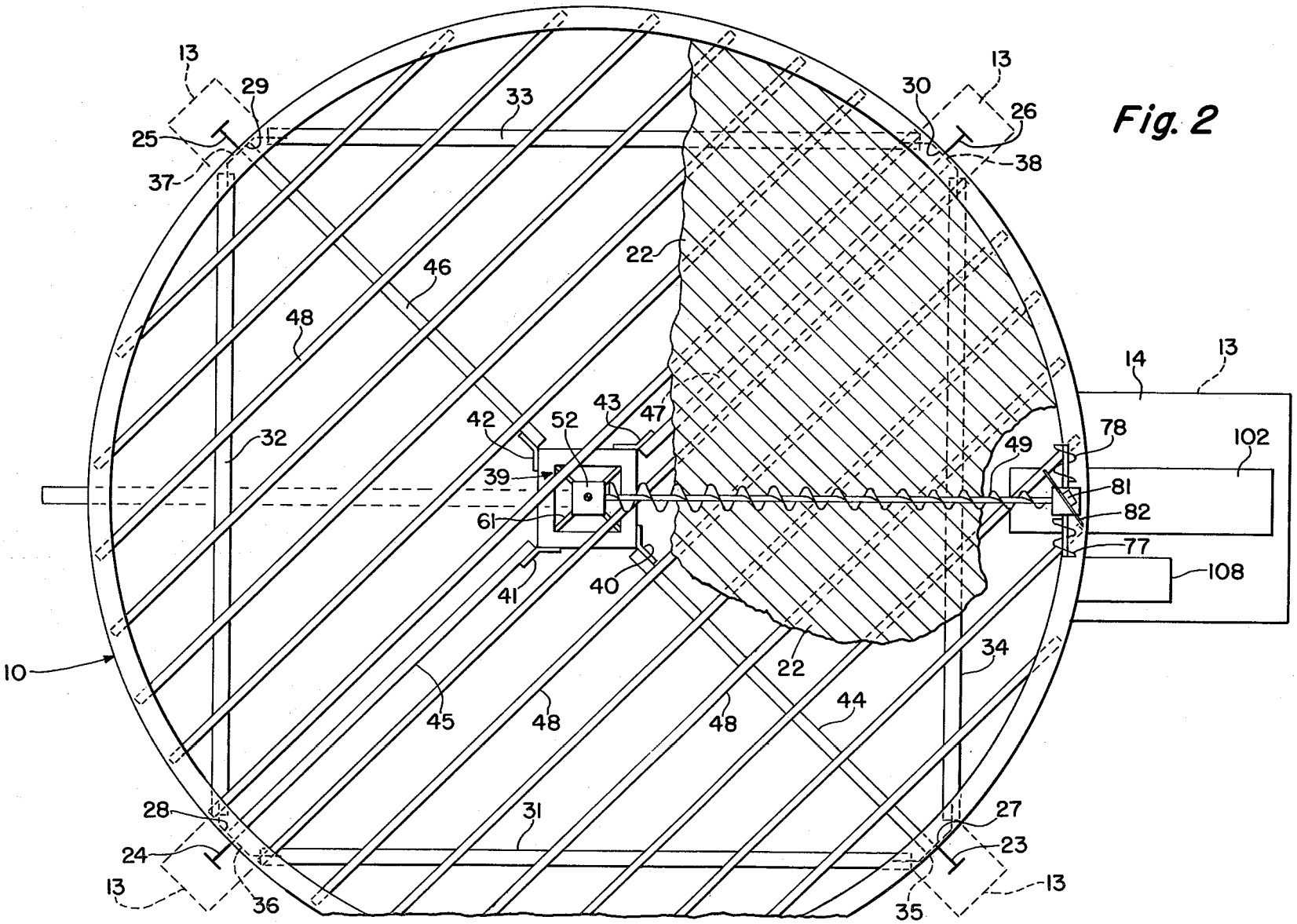

FIG. 2 is a sectional view taken on the line 2—2 of FIG. 1B with portions of the upper perforated floor of the bin broken away for a better illustration of the device of this invention.

Figure 3:
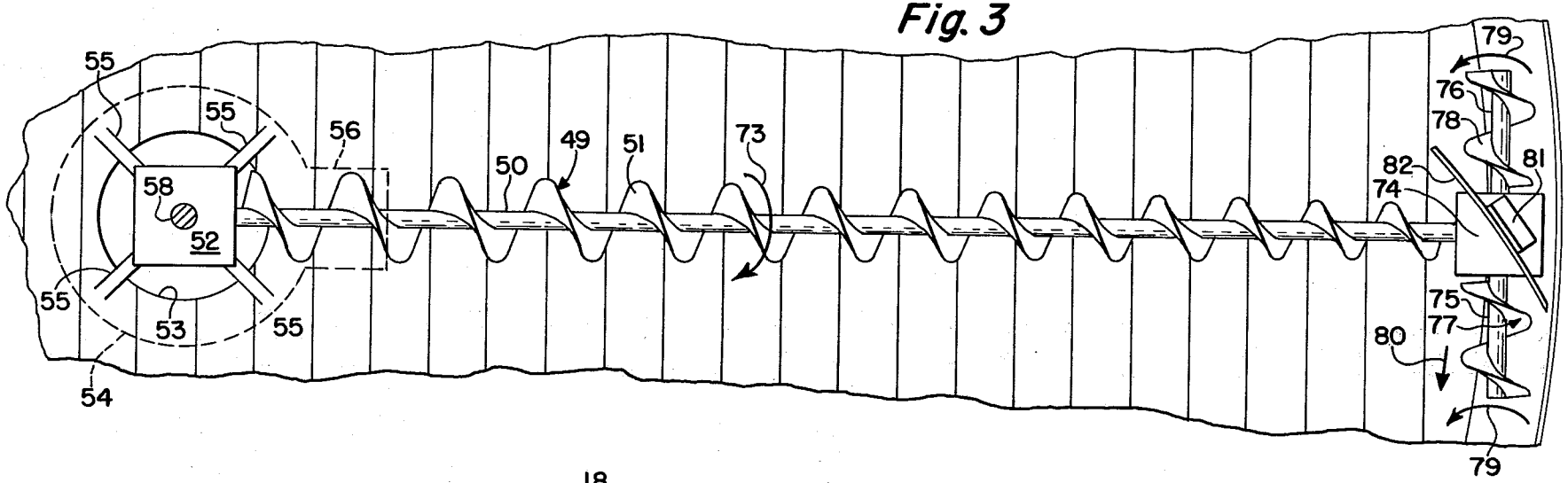

FIG. 3 is an enlarged detail view of the radially disposed sweep auger shown in FIGS. 1B and 2 above the uppermost first perforated floor of the bin.

Figure 4:
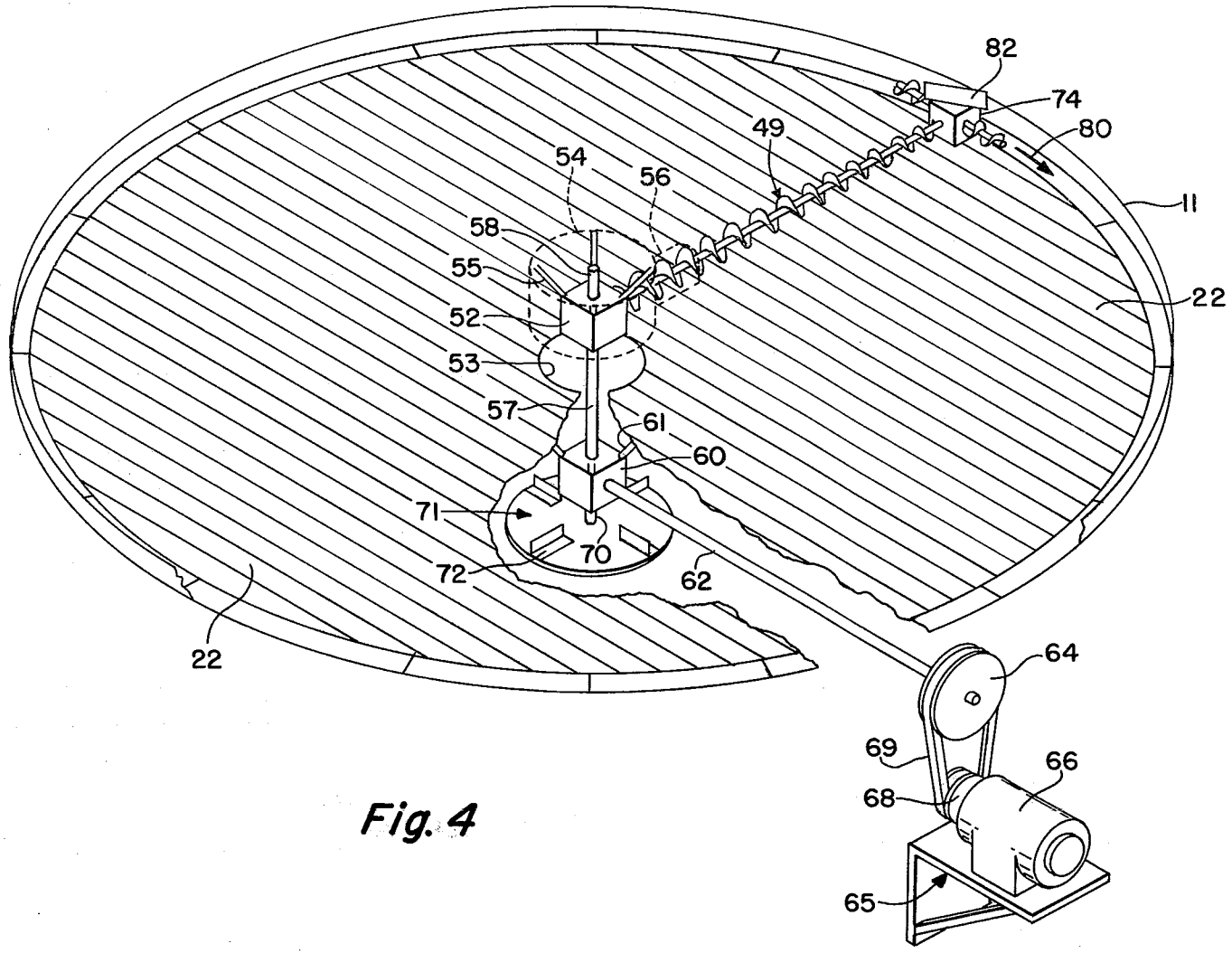

FIG. 4 is a perspective view taken generally of that portion of the bin as shown in the sectional view of FIG. 2.

AS SHOWN IN THE DRAWINGS

The reference numeral 10 indicates generally a cylindrical storage bin for grain. The storage bin is preferably made of corrugated sheet metal and is utilized to normally store grain for periods of time either on the farms where the grain is grown or at commercial establishments. As stated above it is an important object of this invention to convert standard grain storage bins into bins which are capable of effecting drying of the grain. In the present device the bin is of the type having a vertically disposed cylindrical wall 11 and a conical shaped roof or top 12. A plurality of concrete footings 13 are strategically spaced over the desired ground area of the bin location. A generally circular concrete pad or floor 14 is structurally tied into the footings 13 and directly receives the bin 10. The pad 14 is preferably thicker at its circumference to support the side wall loads of the bin.

As best shown in FIG. 1A a fill conveyor 15 is inclined upwardly adjacent the bin 10 and is adapted to deliver moist grain through a discharge spout 16 into an inlet opening 17 in the roof of the bin. The inlet opening is preferably positioned at the apex of the conical shaped roof 12. The inlet opening 17 is equipped with a hinged cover 18 which is preferably closed when the device is not receiving grain to be dried such as the condition shown in FIG. 1A. Following the delivery of grain to be dried to the inlet 17, that grain falls directly into or on a grain spreading device 19. The spreader 19 is disposed directly beneath the opening 17 and may be used with or without power to effect rotation thereof. When the spreader is used without being motorized the grain falls by gravity into the device and with the aid of deflectors (not shown) cause a uniform spreading of the grain over the full planar area of the bin 10. To better illustrate this uniform spreading the grain has been identified by the numeral 20. The incoming grain 20 falls downwardly and builds a substantial grain column 21 in the upper portion of the bin.

The grain column 21 rests on a first or upper perforated floor 22 which not only supports the first and upper column of grain 21 but also divides the bin 10 into an upper chamber above the floor and a lower chamber below the floor. Such a substantial column of grain 21 resting on this upper perforated floor constitutes substantial weight and hence the floor 22 must be adequately supported to carry this great load. Inasmuch as the inventor intends that this be a conversion unit in which the usual storage bin is converted into a bin capable of not only storing but of drying grain it is one of the necessities of conversion that a suitable structural means must be provided for the floor carried midway between the top and bottom of the bin. There are numerous possible ways of effecting a floor support and it should be understood that the support shown is only one such support that would be workable.

Four H-beam supports are each carried in a vertical position on and above one of the concrete footings 13 at equally spaced positions around the cylindrical bin 10. These H-beam supports have one of their side flanges abutting the outer surface of the cylindrical wall 11 of the bin. A bracket member 27 is mounted on the inside of the bin wall 11 at a position adjacent the top of the H-beam 23. Suitable fastener means such as bolts or the like, not shown, are adapted to be passed through the bracket 27, through the bin wall 11, and thence through the flange of the H-beam 23 so that the H-beam is securely held in its vertical position relative to the bin and the bracket 27. This fixing of the top of the H-beam support 23 provides that other members may be carried on the bracket 27 and their load will effectively be transmitted through the support beam 23 down to the concrete footing 13. Similar brackets 28, 29 and 30 are adapted to be applied to the H-beam supports 24, 25 and 26 respectively. A horizontal beam 31 is fixedly fastened at one end to the bracket 27 and at its other end to the bracket 28. A second horizontal beam 32 is disposed at right angles to the horizontal beam 31 and is fixedly fastened at one end to the bracket 28 and at its other end to the bracket 29. A third horizontal beam 33 lies parallel to the beam 31 and is disposed at right angles to the beam 32. The beam 33 is fixedly fastened at one end to the bracket 29 and at its other end to the bracket 30. A fourth horizontal beam 34 lies parallel to and spaced apart from the beam 32 and is disposed at right angles to the horizontal beams 31 and 33. The beam 34 is fixedly fastened at one end to the bracket 30 and at its other end to the bracket 27. The four horizontal beams 31, 32, 33 and 34 all lie in a single horizontal plane and together form a generally square shape as shown in FIG. 2. It is on this square of horizontal beams that the perforated floor 22 is carried and the weight of the substantial column of grain 21 transmitted downwardly to the concrete footings 13 by means of the brackets and the vertical H-beams.

A second series of brackets 35, 36, 37 and 38 are also fastened through the bin wall 11 to the vertical posts 23, 24, 25 and 26 respectively at positions spaced substantially beneath the upper brackets 27, 28, 29 and 30 respectively. A generally square structural frame 39 of relatively small extent is located in the center of the bin 10 and lies in a plane with the relatively large square floor supporting frame of horizontally disposed members 31, 32, 33 and 34. Brackets 40, 41, 42 and 43 are fixedly attached to and project from each corner of the square frame 39. A brace 44 is disposed angularly upwardly within the bin as shown in FIG. 2 and is attached at its upper inner end to the bracket 40 and at its outer lower end to the bracket 35. Braces 45, 46 and 47 are similarly employed. These braces have their upper inner ends attached to the brackets 41, 42 and 43 respectively and their lower outer ends attached to the relatively lower brackets 36, 37 and 38 respectively. The positioning of the diagonal braces is best shown in FIG. 1B wherein the braces 46 and 47 are inclined upwardly and inwardly to give support to the square structural frame 39. A plurality of parallel and diagonally disposed spaced apart floor supporting beams 48 rest on and span the support members 31, 32, 33 and 34 which as previously described form a large square frame. In addition, certain of the centrally located beams 48 rest on the smaller square frame 39 at the center of the bin. The perforated floor 22 rests directly on these beams 48 and by reason of this particular construction the load on the floor 22 is carried downwardly to the concrete footings 13 through the vertical H-beams 23, 24, 25 and 26.

A radially disposed sweep auger 49 is disposed on the upper surface of the perforated floor 22 and extends from a central position of the bin outwardly to the inside of the vertically disposed cylindrical wall 11. The sweep auger 49 as shown in greater detail in FIG. 3 is provided with a core shaft 50 which carries a screw flight 51 thereon. The screw flight 51 is tapered from a maximum diameter at its inner end adjacent the center of the bin to a minimum diameter at its outer end adjacent the outer wall of the bin. A first gear box 52 receives the auger core shaft 50 and is adapted to impart rotational drive to the auger 49 about its shaft 50. A central opening 53 in the perforated floor 22 is adapted to receive grain delivered by the sweep auger 49 thereto for dropping the grain down from the upper chamber in the bin into the lower chamber in the bin. A relatively large cover member 54 is provided over the gear box 52 to prevent grain from falling directly from the column 21 into and through the central opening 53. Brace members 55 are arranged and constructed to join the gear box 52 to the cover 54 thereby insuring that the cover 54 will move with the gear box 52. A tubular projection 56 extends out from one side of the cover 54 to receive and confine the discharging inner end of the sweep auger 49.

As best shown in FIG. 1B a vertical shaft 57 is journalled at its upper end within the gearbox 52 and is the means for delivering rotational drive to the gear box 52. An upwardly extending non-driven post 58 is in alignment with the shaft 57 and is journalled within the cover 54. A disc member 59 is horizontally disposed over the cover 54 and is supported by the upwardly extending post 58. The disc 59 is non-driven and effectively separates the load of the column of grain 21 in the upper chamber from the inner driving end of the radial sweep auger 49. A second gear box 60 is shown at the lower end of the shaft 57. The gear box 60 is in vertical alignment with the gear box 52 but spaced below the gear box 52 and beneath the perforated floor 22 so that it lies in the lower chamber of the bin 10. Brace members 61 fixedly join the gear box 60 to the small square structural frame 39 supported by the inclined brace members 44, 45, 46 and 47 as previously described.

A horizontally disposed drive shaft 62 extends from a position outside the bin wall 11 inwardly to a juncture with the second stationary gear box 60. A bearing support 63 is mounted in the cylindrical wall 11 of the bin to support the shaft 62 as it passes through that wall. As best shown in FIGS. 1 and 4 the outer end of the shaft 62 carries a large V-pulley 64. A shelf 65 is fixedly mounted on the outer wall 11 of the bin 10 and is adapted to carry a motor 66 thereon. A driving shaft 67 of the motor 66 has a generally smaller V-pulley 68 mounted thereon. The V-pulleys 64 and 68 are in planar alignment and by means of a V-belt 69 the V-pulleys are joined together and the motor drive is thereby imparted to the shaft 62 and thus to the second stationary gear box 60. It is thus apparent that the externally positioned motor 66 carries its rotational drive to the gear box 60, thence through the vertical shaft 57 to the first gear box 52 and thus to the radial sweep auger 49.

As shown in FIGS. 1B and 4 the gear box 60 is provided with a downwardly extending shaft 70 which has a disc-like grain spreader 71 mounted on the lower end thereof. The spreader 71 is provided with paddle members 72 on its upper surface so that as the spreader is rotated by reason of the rotation of the shaft 70 it will distribute grain falling through the opening 53 from the upper chamber over the full surface of a column of grain in the lower chamber of the bin.

As best shown in FIG. 3 an arrow 73 shows the direction of rotation of the auger 49 about its central shaft 50 as an axis. This rotation causes a certain quantity of the grain on the underside of the column 21 to be fed radially inwardly of the bin to a position over the central opening 53 in the perforated floor 22. The sweep auger 49 thus must move around the bin floor 22 in order to obtain a continuous uniform flow of grain from the column 21 to the opening 53. A gear box 74 is mounted on the outer end of the radial sweep auger 49 by mounting on the shaft 50 thereof. The auger shaft 50 is journally mounted in the gear box 74 and by suitable bevel gears (not shown) rotational drive of the auger shaft 50 is imparted to a shaft 75 projecting out of the gear box 74 at right angles to the sweep auger shaft 50 but in the same plane. A straight line continuation of the shaft 75 is shown at 76 projecting out of the other side of the gear box 74. A first auger screw flight 77 is mounted on the shaft 75. A second auger screw flight 78 is mounted on the shaft 76. These augers 77 and 78 are disposed at right angles to the sweep auger 49 and themselves form a relatively straight line auger with one portion 77 on one side of gear box 74 and the other portion 78 on the other side of the gear box 74. Arrows 79 indicate the direction of rotation of the stub-like short augers 77 and 78. It is these stub augers which are power rotated in the direction of the arrows 79 that cause the sweep auger 49 to be power driven around the full circular bin 10. The sweep auger 49 with its gear box 52 as a center is revolved around the surface of the perforated floor 22 and engaging the underside of the column of grain 21. Thus, the delivery of grain to the central opening 53 by the sweep auger 49 is regular and uniform and acts to move the heated grain at the bottom of the substantial column 21 to the opening 53 for discharge downwardly therethrough. The stub augers 77 and 78 effectively screw their way through the dense column of heated grain 21 and cause the sweep auger to be revolved in the direction of the arrow 80.

A bracket 81 is affixed to the top of the gear box 74 for the purpose of holding a deflector shield or plow 82 in angular position above the gear box 74. This plow 82 acts to move the grain lying thereabove toward a position to be picked up by the sweep auger 49. In addition this action of the plow 82 prevents the jamming of grain in and around the gear box 74. Thus the drive from the motor 66 not only effectively causes rotation of the sweep auger 49 about its own axis 50, it also causes a positive driving of the sweep auger about the shaft 57 as a center in a revolving action. The sweep auger 49 moving by reason of the stub augers being power driven to positively screw their way through the dense column of grain insures the regular delivery of heated grain to the discharge opening 53.

As the grain falls through the opening 53 in the perforated floor 22 it continues its downward fall generally through the square structural member 39, over and around the lower gear box 60 and thus directly onto the grain spreading disc 71. The disc 71 is power rotated as described above and the paddles 72 thereon cause the downwardly falling grain to be spread uniformly over the full planar surface of the bin and onto a second or lower substantial column of grain 83 in the lower bin chamber beneath the first perforated floor 22. The column of grain 83 rests on a second or lowermost perforated floor 84 spaced considerably below the upper perforated floor 22. A substantial support **84*a* is provided for this lower perforated floor 84 and extends between the concrete floor 14 to the underside of the perforated floor 84. It should be understood that the term perforated when referring to the floors 22 and 84 mean that there are perforations over its surface such as will permit air currents to pass upwardly therethrough but the perforations are sufficiently small to prevent the passage of grain falling through these perforations. The radially disposed sweep auger 85 is substantially the same in construction as the sweep auger 49 operating on and over the upper perforated floor 22. The sweep auger 85 acts to deliver grain from the second or lowermost perforated floor 84 inwardly toward the center of the bin 10. The sweep auger 85 is provided with a core shaft 86 and a screw flight 87 affixed thereto to move grain at the lower portion of the large column of grain 83 lying adjacent the upper surface of the second or lowermost perforated floor 84 in a radially inward direction. The screw flight 87 of the sweep auger 85 is preferably tapered from a maximum diameter at its inner center end to a minimum diameter at its radially outwardly positioned end in the same manner as the sweep auger 49. A motor 88 is loccated at the center of the bin 10 and is adapted to drive the core shaft 86 of the sweep auger 85. A central opening 89 is provided in the perforated floor 84 to permit the grain which has been dried during its vertical movement through the bin to fall by gravity downwardly therethrough. For that portion of the grain in the column 83 which does not move by gravity the operation of the sweep auger 85 will forcefully deliver the balance of the grain in the column 83 radially inwardly to the opening 89. A large cover 90 is provided over the motor 88. This cover is similar to the cover 54 described above for cooperation with the sweep auger 49. The cover 90 basically prevents grain from falling directly through the central opening 89. Brace members 91 join the motor housing to the cover 90. A tubular projection 92 extends out of one side of the cover to receive the passage of the radial sweep auger 85. An upwardly extending non-driven post 94 is journalled within the large cover 90 to support a stationary or non-driven disc member 95. The disc 95 is disposed generally horizontally over the cover 90 and acts to shield the cover from the substantial column of grain 83 to thereby permit the cover 90 and the sweep auger 85 to swing or turn about the central axis of the motor 88**.

The bin 10 is provided with a sub-chamber 97 located beneath the second or lowermost perforated floor 84. A radially disposed discharge auger 98 is provided in the sub-chamber 97 and extends from a position adjacent the center of the bin to a position externally of the bin. The auger 98 is provided with a center shaft 99 which is driven externally of the bin by means not shown. The external rotational drive is imparted to the auger shaft 99 and its rotation causes the auger to discharge dried grain by the discharge auger 98 as it falls through the central opening 89 into the sub-chamber 97.

Similar to the sweep auger 49 operating over the upper perforated floor 22 the sweep auger 85 operating on the perforated floor 84 has stub augers 100 at the outer radial end thereof which effect the revolving of the sweep auger 85 about its centrally disposed power driven motor 88. Thus that grain which does not fall by gravity angularly downwardly from the column 83 and through the central opening 89 will be moved radially inwardly by the sweep auger 85 for discharge of the dried grain downwardly through the center opening 89 where it combines with the gravity falling grain into the sub-chamber 97 and directly onto the discharge auger 98. The auger 98 being power driven removes the dried grain from the bin by delivering it radially outwardly in the direction of the arrow 101.

As best shown in FIGS. 1B and 2 a heating unit 102 is mounted on a concrete footing or base 13 disposed outside of the bin 10. A burner 103 is located within the heating unit 102 and by means of a fan 104, heat from the unit 102 is directed inwardly toward the bin 10. A vertical duct 105 joins the heating unit 102 at its lower end on the inside of the bin 10 and extends upwardly to a discharge opening 106 at a position located above the top surface of the grain column 83 for delivery into a hot air plenum 107 defined by the upper surface of the grain column 83 and the underside of the upper perforated floor 22. Thus the hot air plenum is located at the top of the lower chamber which houses the second column of grain 83. In this position, heat from the heating unit 102 is delivered upwardly through the upper perforated floor 22 and thence through the column of grain 21 carried on the upper perforated floor 22.

A cooling unit 108 is positioned adjacent to the heating unit 102 and is similarly mounted on the concrete pad or base 13. A fan 109 delivering cool air directs that cool air into the sub-chamber 97 of the bin. The entire sub-chamber 97 acts as a cool air plenum defined on its lower side by the concrete floor 14 and on its upper side by the underside of the lower perforated floor 84. The support **84*a* within the sub-chamber 97 and bearing the load of the floor 84 is spaced intermittently therearound without impairing the use of that chamber as the cool air plenum. Inasmuch as the perforated floor 84 carries the second column of grain 83, the cool air delivered to the plenum, comprising the sub-chamber 97, moves upwardly through the perforated floor 84 and thence upwardly through the column of grain 83. As the cool air moves upwardly through the column of grain 83 which has been preliminarily heated in the upper portion of the bin, the cool air heats up and when it arrives at the top of the column 83 it is admixed with the heat from the heating unit in the plenum 107**.

A temperature control device 110 is mounted on the wall 11 of the bin and extends into the vertical heat duct 105. The temperature control device 110 is electrically wired to cause the burner 103 of the heating unit to be actuated when the hot air in the duct 105 drops below some selected desired temperature. A control 111 is mounted on the bin wall 11 and penetrates the wall for engagement with the column of grain 84. This device 111 controls the height of the column of grain 83. Similarly a control 112 is mounted in the wall 11 of the bin for controlling the height of the uppermost column of grain 21 lying above the upper perforated floor 22. Further, there is provided a moisture control device 113 mounted in the cylindrical wall 11 of the bin for reading the moisture content of the grain as that grain approaches the bottom discharge end of the uppermost column of grain 21.

THE OPERATION OF THE DEVICE

As moist grain to be dried is delivered to the top of the bin 10 as shown coming from the spout 16 and into and through the inlet opening 17 a spreader 19 acts to cause the incoming grain to be spread over the full planar surface of the bin forming a column of grain in the upper chamber of the bin 10. The grain then moves vertically downwardly through the bin in a controlled manner during which passage it is effectively dried. Arrows 114 show the direction of movement of hot air from the heating unit 102 upwardly through the vertical duct into the hot air plenum 107, thence upwardly through the perforated floor 22, thence upwardly through the column of grain 21 and thereafter out a roof vent 115 which is located in the conical top or cover of the bin 12 at a position spaced from the grain inlet opening 17. The incoming hot air causes the grain in the column 21 to be heated and the grain thus started in its drying process. The moisture in the grain is further driven out of the grain by reason of the heated grain then being subjected to cool air from the cooling unit 108. Arrows 116 show the path of cool air into the sub-chamber plenum 97, up through the perforated floor 84, up through the lowermost column of grain 83, up through the hot air plenum 107 where it mixes with the hot air from the heating unit 102, thereafter moves with the hot air upwardly through the perforated floor 22, up through the uppermost column of grain 21 and thence out the roof vent 115. This completes the drying operation of the device and at this point the grain being first subjected to heat and then cool air is moved downwardly through the central opening 89 in the perforated floor 84 at the lower side of the bin and thence is removed by the radially disposed discharge auger 98. The arrow 101 defines the path of movement of the dried grain to a position outside of the confines of the bin where it is used or stored as desired.

A control 117 may be employed in association with the hot air plenum 107 to limit the heat delivered thereto. Such a control would be superimposed over the temperature control 110 which acts in response to heat in the duct 105. The control 117 would limit the high temperature in the plenum 107 by turning off the heating unit 102.

I am aware that numerous details of construction may be varied throughout a wide range without departing from the principles disclosed herein and I therefor do not propose limiting the patent granted hereon otherwise than as necessitated by the appended claims.

What is claimed is:

1. A cylindrical storage and drying bin for granular material comprising a cylindrical wall, a generally conical shaped top covering said cylindrical wall, an inlet opening located in the conical shaped top covering at the apex thereof, said inlet opening adapted to receive grain to be dried, a first spreader means located immediately beneath said inlet opening for spreading said grain over the full circular area defined by the cylindrical wall, a first upper perforated floor horizontally disposed in said bin, said first upper perforated floor dividing said bin into an upper chamber thereabove to carry a first column of grain in the drying thereof and a lower chamber therebelow, said first upper perforated floor having a centrally disposed discharge opening for permitting movement of the grain from the column thereof in the upper chamber to the lower chamber, a sweep auger pivotally mounted at its inner end above said centrally disposed discharge opening and extending radially outwardly over said floor to a position adjacent said cylindrical wall, means revolving said sweep auger about its pivotally mounted inner end and rotating said sweep auger about its radial axis, a second grain spreader disposed beneath said centrally disposed discharge opening in said first upper perforated floor to spread the grain over the circular area of the bin defined by the cylindrical wall, a second lower perforated floor horizontally disposed at a location near the bottom of said bin and defining the lower end of the lower chamber, said second lower perforated floor defining the top of a sub-chamber in the bin utilized to remove dried grain from the bin, said second lower perforated floor having a centrally disposed discharge opening for permitting movement of the grain from the lower chamber to the sub-chamber, a second sweep auger pivotally mounted at its inner discharge end above said centrally disposed discharge opening in said second floor and extending radially outwardly over said second floor to a position adjacent said cylindrical wall, means rotating said second sweep auger about its radial axis and revolving it about its pivotal mounting at its inner end, an auger fixedly located in a radial position in said sub-chamber and extending from a position beneath said centrally disposed discharge opening in said second floor to a position beyond the cylindrical wall of the bin, means rotating said auger about its radial axis, said second floor adapted to carry a second column of grain within the lower chamber of the bin, a heating unit carried on the outside of said bin and having hot air passage means communicating with the upper portion of said lower chamber for passage upwardly through the first upper perforated floor and through the column of grain in the upper chamber, said conical shaped top having a vent in the side thereof spaced from the inlet opening to exhaust the moist hot air after it has passed through the column of grain, a cooling unit carried on the outside of said bin and having cold air passage means communicating with said sub-chamber for passage upwardly through the second lower perforated floor and through the column of grain in the lower chamber and thereafter admixing with the hot air for passage up through the first upper perforated floor and through the column of grain in the upper chamber and thence out the vent in the conical shaped top, and said auger in said sub-chamber adapted to remove the dried grain from the bin.

2. A device as set forth in claim 1 in which the means revolving the sweep auger comprises a gear box at the outer radial end of said sweep auger and driven thereby, and a stub auger driven by said gear box, said stub auger disposed at right angles to said sweep auger and arranged to screw into and through the column of grain.

3. A device as set forth in claim 2 in which said screw flight of said auger sweep means is tapered from a relatively small diameter at its outer end to a relatively large diameter at its inward end adjacent said central discharge opening.

4. A cylindrical storage and drying bin for granular material comprising a cylindrical wall, a generally conical shaped top covering said cylindrical wall, an inlet opening located in the conical shaped top covering at the apex thereof, said inlet opening adapted to receive granular material to be dried, a first spreader means located immediately beneath said inlet opening for spreading said granular material over the full circular area defined by the cylindrical wall, a first floor horizontally disposed and circularly shaped and sized to fill the cylindrical wall of the bin at a location intermediate the top and bottom of said bin, said first floor dividing said bin into an upper chamber thereabove to carry a first column of granular material in the drying thereof and a lower chamber therebelow, means supporting said first floor in a fixed position within said bin, said first floor having perforations of a size sufficiently small to prevent passage therethrough of the granular material, said first floor having a centrally disposed discharge opening for permitting movement of the granular material from the column thereof in the upper chamber to the lower chamber, a sweep auger pivotally mounted at its inner end above said centrally disposed discharge opening in the first floor and extending radially outwardly over said first floor to a position adjacent said cylindrical wall, means revolving said sweep auger about its pivotally mounted inner end and rotating said sweep auger about its radial axis, said means revolving and rotating comprising a vertical shaft disposed in and through said centrally disposed discharge opening, a first gear box on the inner end of said sweep auger, a second gear box disposed in vertical alignment with said first gear box and located beneath said first floor, said vertical shaft joined at its top to said first gear box and at its bottom to said second gear box, means imparting drive to said second gear box, a second granular spreader means disposed beneath said second gear box and receiving drive therefrom, said second spreader means located closely below said centrally disposed discharge opening in said first floor and adapted to spread the granular material over the full circular area defined by the cylindrical wall, a second floor horizontally disposed and circularly shaped and sized to fill the cylindrical wall of the bin at a location near the bottom of said bin and defining the lower end of the lower chamber, said second floor defining the top of a sub-chamber in the bin utilized to remove granular material from the bin, said second floor having perforations of a size sufficiently small to prevent passage therethrough of the granular material, said second floor having a centrally disposed discharge opening for permitting movement of the granular material from the lower chamber to the sub-chamber, a second sweep auger pivotally mounted at its inner discharge end above said centrally disposed discharge opening in said second floor and extending radially outwardly over said second floor to a position adjacent said cylindrical wall, means intermittently rotating said second sweep auger about its radial axis and revolving it about its pivotal mounting at its inner end, an auger fixedly located in a radial position in said sub-chamber and extending from a position beneath said centrally disposed discharge opening in said second floor to a position beyond the cylindrical wall of the bin, means rotating said auger about its radial axis, said second floor adapted to carry a second column of the granular material within the lower chamber of the bin, a heating unit carried on the outside of said bin and having hot air passage means communicating with the upper portion of said lower chamber for passage upwardly through the perforated first floor and through the column of granular material in the upper chamber, said conical shaped top having a vent in the side thereof spaced from the inlet opening to exhaust the moist hot air after it has passed through the column of granular material, a cooling unit carried on the outside of said bin and having cold air passage means communicating with said sub-chamber for passage upwardly through the perforated second floor and through the column of granular material in the lower chamber and thereafter admixing with the hot air for passage up through the perforated first floor and through the column of granular material in the upper chamber and thence out the vent in the conical shaped top, and said auger in said sub-chamber adapted to remove the dried granular material from the bin.

* * * * *